US011554476B2

(12) United States Patent
Ejiri et al.

(10) Patent No.: US 11,554,476 B2
(45) Date of Patent: Jan. 17, 2023

(54) POWER TOOL

(71) Applicant: Koki Holdings Co., Ltd., Tokyo (JP)

(72) Inventors: Tomohiro Ejiri, Ibaraki (JP); Masahiro Fujiwara, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 0 days.

(21) Appl. No.: 16/957,375

(22) PCT Filed: Nov. 30, 2018

(86) PCT No.: PCT/JP2018/044199
§ 371 (c)(1),
(2) Date: Jun. 23, 2020

(87) PCT Pub. No.: WO2019/130981
PCT Pub. Date: Jul. 4, 2019

(65) Prior Publication Data

US 2020/0331138 A1 Oct. 22, 2020

(30) Foreign Application Priority Data

Dec. 28, 2017 (JP) ..... JP2017-253411

(51) Int. Cl.
*B25F 5/00* (2006.01)
*B24B 23/02* (2006.01)

(52) U.S. Cl.
CPC ..... *B25F 5/008* (2013.01); *B24B 23/02* (2013.01)

(58) Field of Classification Search
CPC .... B25F 5/00; B25F 5/008; B25F 5/02; B24B 23/02; B24B 23/028
(Continued)

(56) References Cited

U.S. PATENT DOCUMENTS 6,543,549 B1 4/2003 Riedl et al.
7,770,660 B2 * 8/2010 Schroeder ..... B25F 5/02 173/171
(Continued)

FOREIGN PATENT DOCUMENTS

CN 1249225 4/2000
CN 1416380 5/2003
(Continued)

OTHER PUBLICATIONS

"International Search Report (Form PCT/ISA/210) of PCT/JP2018/044199", dated Jan. 29, 2019, with English translation thereof, pp. 1-4.
(Continued)

*Primary Examiner* — Andrew M Tecco
*Assistant Examiner* — Jacob A Smith
(74) *Attorney, Agent, or Firm* — JCIPRNET

(57) ABSTRACT

The power tool has a housing portion that accommodates a motor (6) and a cooling fan (8), and a handle portion (5B). Air suction ports (41, 42*a*-42*d* and 43) are arranged in the housing portion, and outside air is sucked into the housing portion by the rotation of the cooling fan. In the power tool, a passage (52) is formed in the handle portion, the passage guiding cooling air from the air suction port (41) rearward away from the cooling fan; the cooling air is caused to flow from an opening (53) into the handle portion to cool a heat-generation mechanism included in a switch mechanism (60); and the cooling air is again returned to the housing portion. In the housing portion, the cooling air is discharged to the outside from air discharge ports (13*a* and 13*b*) together with the cooling air from the other air suction ports.

18 Claims, 9 Drawing Sheets

(58) Field of Classification Search
USPC ..... 173/170, 200, 217
See application file for complete search history.

(56) References Cited

U.S. PATENT DOCUMENTS

| | | | | |
|---|---|---|---|---|
| 2004/0124721 | A1* | 7/2004 | Pfisterer | H02K 11/05 310/58 |
| 2005/0153636 | A1* | 7/2005 | Numata | B25F 5/008 451/358 |
| 2010/0270877 | A1 | 10/2010 | Esenwein et al. | |
| 2011/0148227 | A1 | 6/2011 | Schuele et al. | |
| 2016/0193727 | A1* | 7/2016 | Takeda | B25F 5/008 173/46 |
| 2017/0196419 | A1 | 7/2017 | Brown et al. | |

FOREIGN PATENT DOCUMENTS

| | | | | |
|---|---|---|---|---|
| CN | 102441877 | | 5/2012 | |
| CN | 105829031 | | 8/2016 | |
| CN | 107053095 | | 8/2017 | |
| CN | 107206585 | | 9/2017 | |
| JP | S58-150484 | | 10/1983 | |
| JP | 2008290236 | | 12/2008 | |
| JP | 2009296803 | | 12/2009 | |
| JP | 2011104671 | | 6/2011 | |
| JP | 2012000749 | | 1/2012 | |
| JP | 2014012142 | | 1/2014 | |
| JP | 201497570 | A * | 5/2014 | B25F 5/00 |
| JP | 2014097570 | | 5/2014 | |
| JP | 2014097570 | A * | 5/2014 | B25F 5/00 |
| JP | 2017119341 | | 7/2017 | |

OTHER PUBLICATIONS

"Search Report of Europe Counterpart Application", dated Oct. 5, 2020, pp. 1-8.

"Office Action of China Counterpart Application" with English translation thereof, dated Sep. 2, 2022, p. 1-p. 25.

* cited by examiner

A−A

B−B

POWER TOOL

CROSS-REFERENCE TO RELATED APPLICATION

This application is a 371 application of the International PCT application serial no. PCT/JP2018/044199, filed on Nov. 30, 2018, which claims the priority benefits of Japan Patent Application No. 2017-253411, filed on Dec. 28, 2017. The entirety of each of the above-mentioned patent applications is hereby incorporated by reference herein and made a part of this specification.

BACKGROUND OF THE INVENTION

Technical Field

The present invention relates to a power tool in which a heat-generation member is accommodated in a handle portion, and relates to a technique for guiding air introduced from a cooling air introduction port into the handle portion.

Related Art

A power tool that works while being gripped by an operator is equipped with a handle portion for the operator to grip. In particular, in a heavy power tool, a handle portion is arranged to extend from a housing that accommodates a motor or a power transmission mechanism, or a handle portion is formed in a part of the housing. An operation switch of the motor is arranged in the handle portion, and the operator operates the operation switch while gripping the handle. The conventional technique having the handle portion behind the housing is disclosed in patent literature 1 for example.

Literature of Related Art

Patent Literature

Patent literature 1: Japanese Patent Laid-Open No. 2009-296803

Patent literature 2: Japanese Patent Laid-Open No. 2017-119341

SUMMARY

Problems to be Solved

In a large-sized grinder as described in patent literature 1, a commercial AC power supply is used to drive a large-sized motor. A grindstone to be used is a large grindstone with an outer diameter of 180 mm or more and has a total weight exceeding 4 kg, and thus the operator works while gripping a handle portion located behind the grinder and a side handle located in front of the grinder. In recent power tools, a soft start function for suppressing a start current is used to prevent a large start current from flowing through the motor when a trigger lever is pulled. In order to realize the soft start function, a control circuit for controlling the rotation of the motor is arranged. A semiconductor switching element such as a triac or the like is used for the control circuit. In recent years, a switch unit has been proposed in which the control circuit including the switching element such as a triac or the like is arranged in a housing body of a switch mechanism arranged in the handle portion. Because the switching element generates heat due to the switching operation, overheating of the switching element may adversely affect the control circuit. In addition, because the position of the switching element, which is a heat-generation source, and the position of a site to grip in the handle portion are close to each other, there is also a possibility that the temperature of the handle portion increases and the operator feels uncomfortable.

One solution to prevent the temperature increase of the handle portion is to dispose an air window in the handle portion to guide cooling air for cooling the motor or the like into the handle portion, but the arrangement of the air window is difficult because the handle portion is too thin to arrange an air window having a sufficient size and is a part gripped and covered by the operator during work. In addition, the switch mechanism has a connection terminal for a commercial AC power supply that produces a high voltage, and the sucked air may blow against the connection terminal depending on the arrangement of the air window. In a power tool such as a grinder or the like that is assumed to be used in an environment where metal powder is scattered, the metal powder may accumulate near the terminal of the switch portion. Hence, this arrangement of the air window is not preferable. In addition, even in a relatively small grinder as described in patent literature 2, which uses the periphery of a motor accommodation part as a handle portion and accommodates the switch mechanism on the front side of a rear cover equipped with an air suction port at the rear part, it is necessary to devise cooling for the switch mechanism and the like so that dust does not accumulate at the connection terminal.

The present invention has been made in view of the above background, and an objective of the present invention is to provide a power tool configured so that it is possible to use cooling air to effectively cool a heat-generation member accommodated in a handle portion. Another objective of the present invention is to provide a power tool in which an inlay structure of a divided joining surface of the handle portion is used to configure a cooling air passage for guiding a part of cooling air for motor cooling taken in by a housing portion into a handle portion. Still another objective of the present invention is to provide a power tool configured so that a heat-generation member is accommodated in a switch unit in a handle portion and a heat-radiation plate is arranged in the switch unit, and cooling air guided into the handle portion effectively blows against the heat-radiation plate. Still another objective of the present invention is to provide a power tool configured so that it is possible to transmit air from an air suction port into a handle portion connected to a housing portion having the air suction port and an air discharge port, thereby cooling a heat-generation element accommodated in a part different from the housing portion.

Means to Solve Problems

Representative features of the invention disclosed in this application are described as follows.

According to one feature of the present invention, a power tool is provided which has a motor, a cooling fan that cools the motor, a housing that accommodates the cooling fan and the motor, and a handle portion connected to the housing; wherein a first air suction port is arranged in the housing, and a passage extending in a direction from the first air suction port to the handle portion and returning to the housing again through the handle portion is arranged; a flow of cooling air directed from the first air suction port toward the cooling fan is generated by the cooling fan to cool a heat-generation member arranged in the handle portion. A second air suction port is further arranged in the housing; a flow of second cooling air directed from the second air suction port toward the motor is generated by the cooling fan; and the first cooling air flowing through the first passage and the second cooling air are sucked by the cooling fan after merging with each other and are discharged to the outside from an air discharge port arranged in the housing. Here, the passage extending in the direction from the first air suction port to the handle portion is isolated from the flow of the second cooling air.

According to another feature of the present invention, a switch unit having a trigger lever and a switch main body is accommodated in the handle portion, the switch main body being operated by the trigger lever and turning on/off the motor, and the heat-generation member is arranged in the switch unit. A heat-radiation plate is arranged in the heat-generation member, and the heat-radiation plate is exposed to the flow of the cooling air directed from the first air suction port toward the cooling fan. The heat-radiation plate may be disposed so as to have a surface parallel to the flow direction of the cooling air directed from a return part of the first passage toward the cooling fan. Furthermore, a plurality of the first air suction ports and a plurality of the second air suction ports are arranged on the housing side other than the handle portion, and one of the second air suction ports is disposed adjacent to the front side or the lower side of the first air suction port. Furthermore, the opening area of the second air suction port disposed adjacent to the first air suction port is made smaller than that of an inlet of the first air suction port. Because the second air suction port is disposed adjacent to the first air suction port in this manner, it is possible to ensure that a large amount of dust reaching the vicinity of the first air suction port is sucked to the second air suction port side, and it is possible to prevent dust from entering the first air suction port.

According to still another feature of the present invention, the handle portion is formed by being divided in the left-right direction, and the first passage is formed so as to extend in one surface direction from a joining surface of the housing joined in a two-part shape. In order to form the first passage, a concave portion is formed on one of the division surfaces of the handle portion, and a convex portion or a protrusion portion shaped to block the concave portion from the other division surface is made to overlap the concave portion. At this time, by making the depth of the groove of the concave portion larger than the height of the peak of the convex portion or the protrusion portion, a space is generated between the concave portion and the convex portion, and thus the space can be used as the first passage. In addition, an electric power supply portion is arranged at an end of the handle portion far from the housing, and the position serving as a return part of the first passage is disposed closer to the cooling fan than a connection part connecting the electric power supply portion and the switch unit. In this manner, it is possible to form a configuration in which air is caused not to flow between the switch unit and the electric power supply portion as much as possible.

According to still another feature of the present invention, air is sucked into the housing from the air suction port by the rotation of the cooling fan in the housing provided with the air suction port and the air discharge port. In the housing, the sucked air forms, inside the handle portion, a U-turn-shaped passage for moving in a direction away from the air suction port with respect to the air discharge port and returning to the housing side again and cools the heat-generation element inside the handle portion in the return part of the U-turn passage. Thereafter, the cooling air returns to the housing again and is discharged from the air discharge port via the cooling fan. A control element that controls the motor is disposed in the middle of the U-turn passage. In addition, a switch capable of turning on/off the motor by the operation of an operator is accommodated inside the handle portion, and the control element is arranged in the switch. Furthermore, the air suction port includes a first air suction port and a second air suction port, and a flow of first cooling air in a direction away from the cooling fan is formed from the first air suction port, and a flow of second cooling air in a direction approaching the cooling fan is formed from the second air suction port.

Effect

According to the present invention, a part of the cooling air for cooling the motor can be transmitted to a part which is different from the housing and in which it is difficult to arrange an air window, for example, it is possible to transmit the cooling air to the heat-generation member accommodated inside the handle portion, and thus it is possible to realize a power tool capable of preventing the heat of the heat-generation member from being transmitted to the hand of the operator and capable of performing comfortable work. In addition, because the air suction port for the air guided into the handle portion is disposed on the housing side other than the handle portion, it is possible to reliably prevent the air suction port from being blocked by the hand of the operator, and it is possible to prevent the air suction port from being blocked due to the intrusion of foreign matter such as fibers of a protective glove of the operator. Furthermore, because the cooling air path is realized in the handle portion using the division surfaces of the handle portion configured in two parts, it is possible to realize a power tool having a handle portion in which the outer diameter can be prevented from becoming large and which is used as easily as before.

DESCRIPTION OF THE EMBODIMENTS

Example 1

Figure 1:
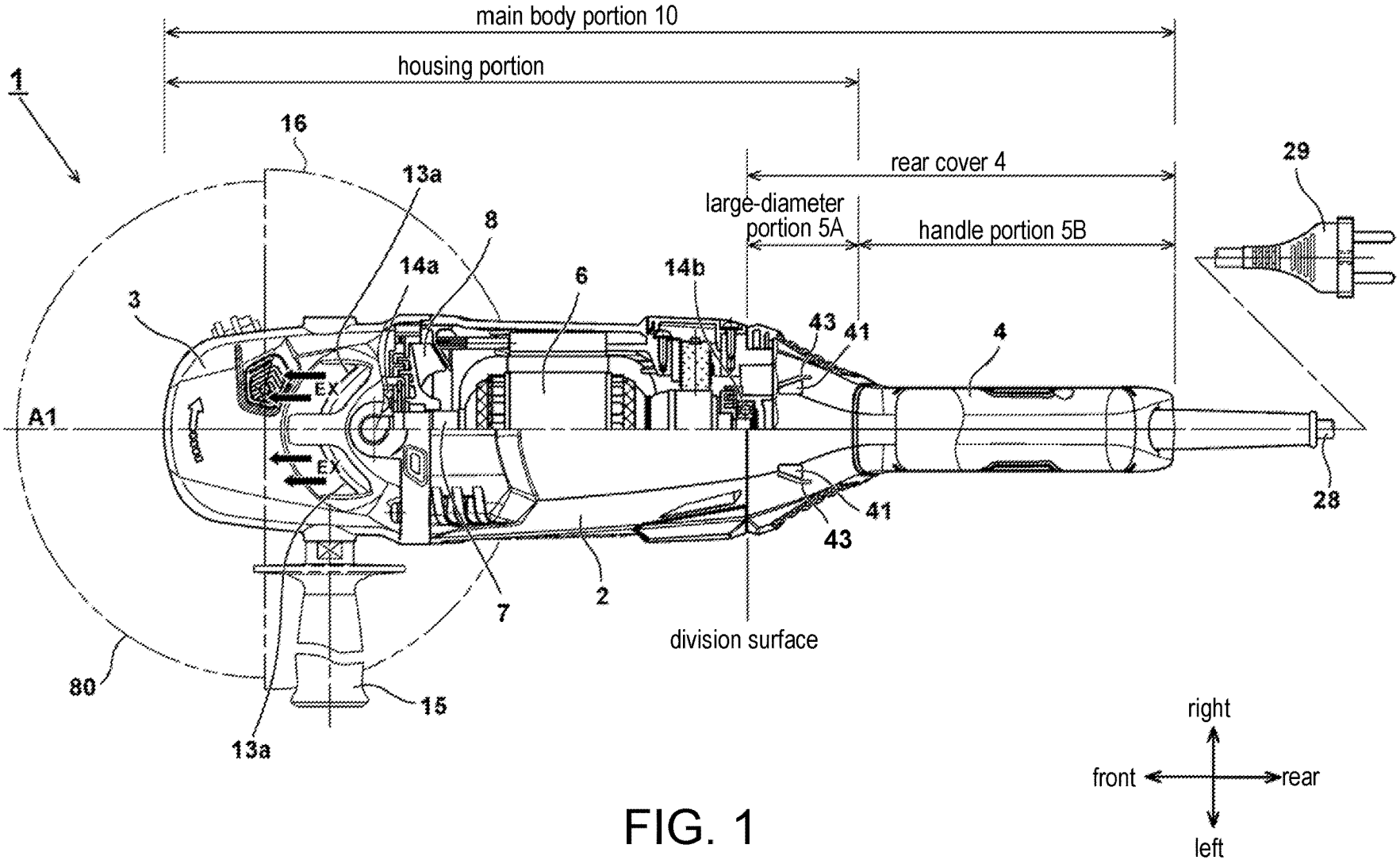
FIG. 1 is a top view of a grinder 1 according to an example of the present invention, in which a part is shown in a perspective view.

Hereinafter, examples of the present invention are described based on the drawings. Here, description is made using a grinder as an example of a power tool which has a handle portion for an operator to grip behind a housing that accommodates a motor and a power transmission mechanism and in which a trigger switch mechanism is arranged in the handle portion. In the following drawings, the same parts are denoted by the same reference signs, and the repeated description is omitted. In addition, in this specification, the front, rear, left, right, up, and down directions are described as directions shown in the drawings.

FIG. 1 is a top view of a grinder 1 according to an example of the present invention. As shown in FIG. 1, the grinder 1 includes a disc-shaped grindstone 80 serving as a front end tool (a rotary tool), and is used in a grinding operation or the like for flattening the surface of a concrete, a stone or the like. The front end tool to be attached is not limited to the disk-shaped polishing grindstone, and a cutting grindstone, a disk-shaped brush, a cutter, or the like can also be attached. A main body 10 of the grinder 1 has a gear case 3, a motor housing 2, and a rear cover 4. The motor housing 2 accommodates a motor 6 serving as a drive source therein and is an integrally molded product made of a substantially cylindrical synthetic resin. As for the motor 6, a universal motor using AC electric power such as a commercial power supply or the like can be used, but the type of the motor 6 is not limited to the universal motor, and other types of motors may be used.

The rear cover 4 is attached to the rear side of the motor housing 2. The front side of the rear cover 4 serves as a large-diameter portion 5A and the rear side of the rear cover 4 serves as a small-diameter handle portion 5B for the operator to grip with one hand. The rear cover 4 is a molded product of a synthetic resin and is manufactured by being divided into two in the left-right direction by a vertical plane passing through a center axis A1. The grinder 1 of the example has a shape in which a housing portion is formed by the gear case 3, the motor housing 2, and a part (the large-diameter portion 5A) of the rear cover 4 and the handle portion 5B is connected to the rearward of the housing portion. A power cord 28 serving as an electric power supply portion is arranged at the rear end of the rear cover 4, and electric power is supplied to the motor 6 from a commercial AC power supply by the power cord 28. At the front end of the power cord 28, a power plug 29 to be mounted on a socket is arranged.

The gear case 3 is attached to the front opening of the motor housing 2 and is made of metal such as an aluminum alloy or the like. The gear case 3 accommodates a drive transmission part (described later in FIG. 2) that converts the power transmission direction determined by a rotary shaft 7 of the motor 6 by about 90 degrees. A side handle 15 is attached to the left side surface of the gear case 3. The side handle 15 is detachable and can also be attached to the right side of the gear case 3. The grindstone 80 is attached to the lower end of the gear case 3. A wheel guard 16 that covers about half of the outer periphery on the rear side is attached around the grindstone 80. The grinder 1 generates a flow of cooling air in the housing by a cooling fan 8 attached to the rotary shaft 7 on the front side of the motor 6 in order to cool the motor that generates heat during work. The cooling air generated by the cooling fan 8 is sucked from the outside by a plurality of air suction ports 41-43 formed in the large-diameter portion 5A of the rear cover 4, reaches the cooling fan 8 through the periphery of a rotor or a stator of the motor 6, and is discharged to the outside as indicated by an arrow EX via air discharge ports 13*a* of the gear case 3. The air discharge ports 13*a* are formed at two sites on the left and right sides of the gear case 3. Another air discharge port for the cooling air EX is arranged, which is described later with reference to FIG. 2.

Figure 2:
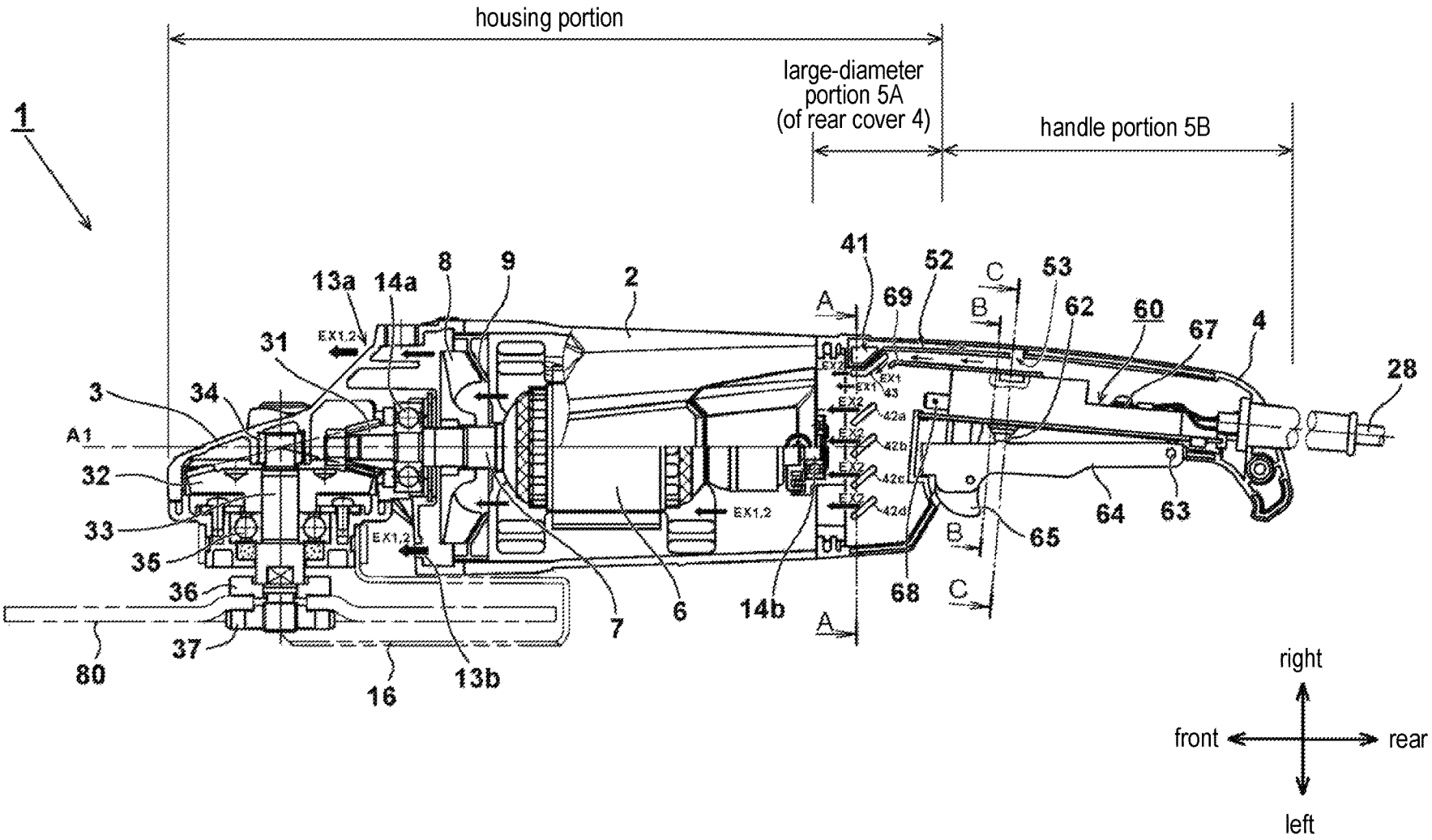
FIG. 2 is a longitudinal cross-sectional view of the grinder 1 according to the example of the present invention, in which a part is shown in a perspective view or a side view.

FIG. 2 is a longitudinal cross-sectional view of the grinder 1 according to the example of the present invention. The grinder 1 has a housing portion that accommodates the motor 6, the fan (cooling fan) 8 that generates cooling air, and a power transmission mechanism, and has a shape in which the handle portion 5B for an operator to grip is connected to the rear side of the housing. The rotary shaft 7 of the motor 6 is disposed so that the axial direction thereof becomes the front-rear direction (the direction of the center axis A1), and the handle portion is also formed so as to extend rearward substantially in parallel with the center axis A1.

The rotary shaft 7 of the motor 6 is supported by two bearings 14*a* and 14*b*, and a first bevel gear 31 is arranged at the front end of the rotary shaft 7. A spindle 33 of which the axial direction becomes an up-down direction is arranged inside the gear case 3, and a second bevel gear 32 that engages with the first bevel gear 31 is arranged in the spindle 33. The spindle 33 is rotatably supported by an upper bearing 34 of a metal-type and a lower bearing 35 formed by a ball bearing. The rotation of the motor 6 is transmitted to the spindle 33 in the manner of converting the rotation direction by 90 degrees by the first bevel gear 31 and the second bevel gear 32 and reducing the rotation speed. That is, the spindle 33 is driven to rotate by the motor 6. The axial direction of the spindle 33 is orthogonal to the rotary shaft 7 of the motor 6, and the lower end of the spindle 33 protrudes to the external space of the gear case 3, and the grindstone 80 is attached to the front end of the spindle 33. The grindstone 80 is fixed to the spindle 33 by a wheel washer 36 and a lock nut 37 and rotates integrally with the spindle 33.

A trigger switch mechanism for activating the motor 6 is arranged on the rear cover 4. The trigger switch mechanism includes a switch unit 60 having an elongated box shape, and a trigger lever 64 that swings by a small angle by a swing shaft 63 fixed to the rear side of the switch unit 60. The operator moves the trigger lever 64 upward while gripping the handle portion 5B of the rear cover 4, and pushes a plunger 62 upward. Thereby, the switch is turned on, electric power is supplied to the motor 6 and the motor 6 rotates. The switch unit 60 having an elongated box shape is a unit accommodating a switch or other electronic components in a housing body made of a synthetic resin, and a primary terminal 67 for connecting the power cord 28 is arranged on the rear side, and a secondary terminal 68 for wiring to the motor 6 side is arranged on the front side. Here, a single-phase alternating current is used as a power supply, and thus the primary terminal 67 and the secondary terminal 68 are configured by two metal terminals. The primary terminal 67 and the secondary terminal 68 are arranged on the rear side and the front side of the switch unit 60 and are sufficiently separated from each other.

When the trigger lever 64 arranged on the rear cover 4 is operated, electric power is supplied to the motor 6 and the motor 6 rotates. Then, the spindle 33 connected to the rotary shaft 7 via the first bevel gear 31 and the second bevel gear 32 rotates, and the grindstone 80 fixed to the spindle 33 rotates. Then, the cooling fan 8 arranged on the rotary shaft 7 also rotates, and thus air flows into the housing from the air suction ports 41, 42*a*, 42*b*, 42*c* and 42*d* and the like due to the rotation of the cooling fan 8. The flow of air is indicated by a black arrow in the drawing. The air suction ports 42*a*, 42*b*, 42*c* and 42*d* are air windows arranged at substantially the same positions as those arranged in the conventional grinder, and the outside air taken in from the air suction ports 42*a*, 42*b*, 42*c* and 42*d* flows to the front side in the direction of the central axis A1 as indicated by an arrow EX2 and cools the motor 6, and then reaches the cooling fan 8 from the vicinity of the center of a fan guide 9, that is, from a part near the rotary shaft 7. The cooling fan 8 is a centrifugal fan and blows air from the axial direction to the entire peripheral part on the outer side in the radial direction in which the air is sucked. A part of the air sent from the cooling fan 8 is discharged forward from the upper air discharge port 13*a* (see FIG. 1) of the gear case 3, and the rest is discharged, as indicated by the arrow, from the air discharge port 13*b* arranged near the front lower end of the motor housing 2.

The grinder 1 of the example has a so-called "soft start" function. The soft start function realizes a smooth start of the motor 6 by making the rising of the voltage and current slow when the switch mechanism is turned on. A triac is used for this soft start function. The triac is a type of semiconductor switching element and is widely used as an AC switch. In particular, the electric power supplied to the load can be controlled by changing an ON period for each half cycle of the alternating current. The triac is accommodated inside the switch unit 60, and a large heat-radiation plate 69 made of aluminum is arranged in the housing body of the switch unit 60 so that heat is generated along with the operation of the triac.

The grinder 1 further has a function for making sure that the motor 6 is not started when power is supplied with the trigger lever 64 pulled out first. This is a safety function for making sure that, when the operator inserts the power plug 29 into the socket and holds the trigger lever 64, the motor 6 does not rotate unless the trigger lever 64 is temporally turned off and then gripped again. By arranging this safety function, it is possible to prevent the motor 6 from suddenly rotating without an intention of the operator. The function is particularly useful for the occurrence of a power failure. When the power failure occurs while the operator pulls the trigger lever 64 to perform a polishing operation, and the power failure is recovered in the state that the operator does not return the trigger or an on-lock function for the trigger switch is set, the grindstone 80 can be prevented from suddenly rotating.

A control device, which realizes the "soft start" function or the function of preventing motor rotation upon recovery from power failure as described above, is mounted on a circuit board arranged independently of the switch mechanism in the conventional grinder. For example, the circuit boards for control circuit are mounted in internal spaces of the air suction ports 42*a*, 42*b*, 42*c* and 42*d* in the conventional grinder. In this case, because the outside air sucked from the air suction ports 42*a*, 42*b*, 42*c* and 42*d* blows against the control circuit boards, there is no problem in cooling of the heat-generation member mounted on the circuit boards. However, in recent years, these control circuits have been built in the switch unit 60, and thus there arise a problem of heat generation which has not been a problem in the conventional switch mechanism. In the example, the problem is solved by arranging the heat-radiation plate 69 in the switch unit 60. However, along with the arrangement of the heat-radiation plate 69, a part of the cooling air sucked into the housing portion by the cooling fan 8 is guided to the switch unit 60 side, and the cooling air actively blows against the heat-radiation plate 69. Here, air suction ports 41 are newly arranged in the large-diameter portion 5A of the rear cover 4, and the cooling air EX1 sucked via the air suction ports 41 is guided rearward through a dedicated passage 52 in the handle portion and is discharged to the upper part of the switch unit 60 through an opening 53. The passage 52 is formed using concave and convex parts of the inlay structure of the division surfaces of the rear cover 4 (4-1 and 4-2) (the detailed structure is described specifically in FIG. 5 and subsequent drawings). The cooling air EX1 sucked via the air suction ports 41 flows rearward in the handle portion 5B and is discharged from the opening 53. Then, The cooling air EX1 flows in the direction of approaching the cooling fan 8 from the opening 53, and flows to the front side in the direction of the center axis A1 toward the direction of the cooling fan 8 on the front side after merging with the other cooling air EX2 sucked by the air suction ports 42*a*, 42*b*, 42*c* and 42*d*.

Figure 3:
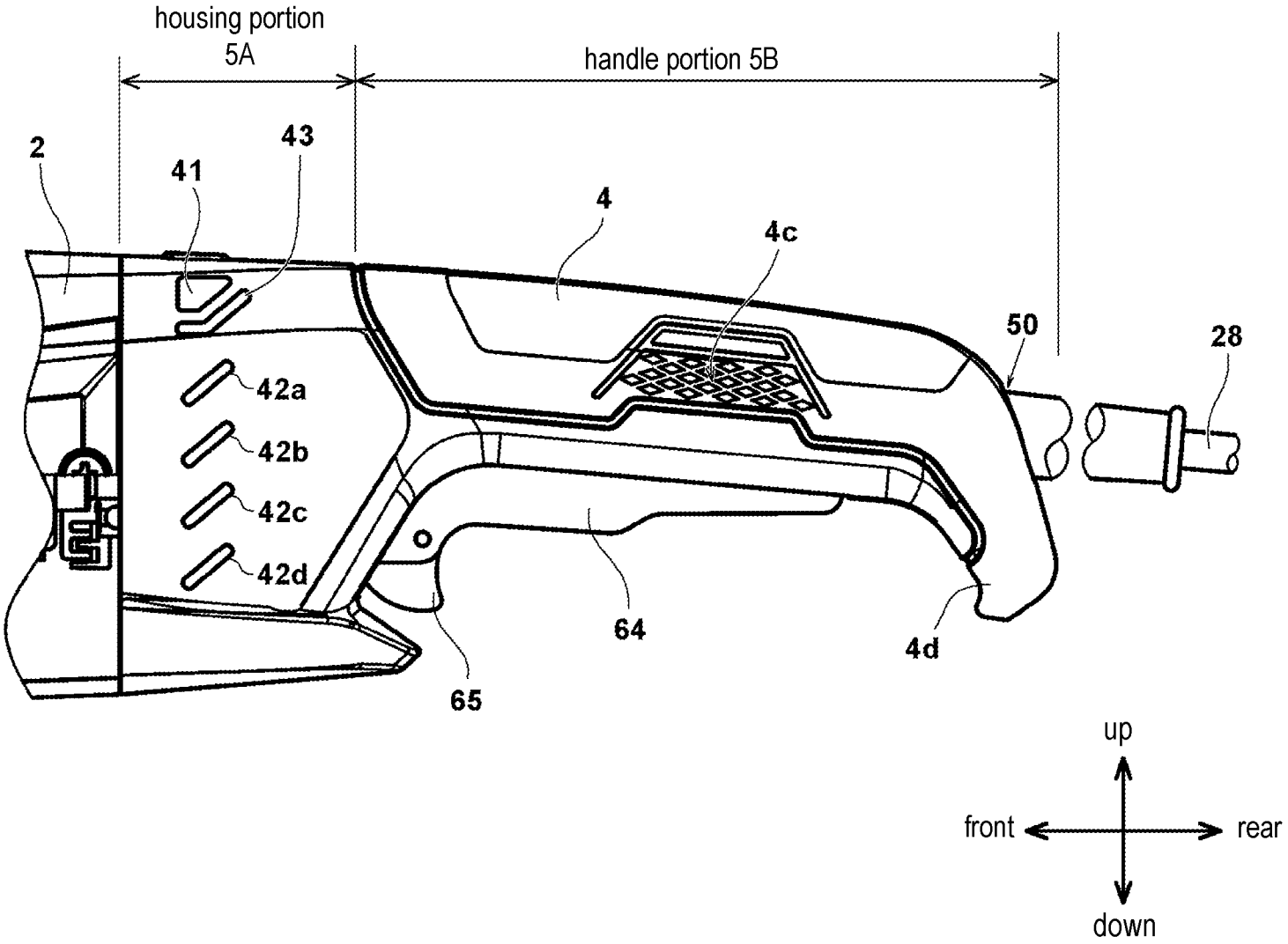
FIG. 3 is a left side view of a rear cover 4 of the grinder 1 according to the example of the present invention.

FIG. 3 is a left side view of the rear cover 4 of the grinder 1 according to the example of the present invention. In the large-diameter portion 5A on the front side of the rear cover 4, the air suction ports 41, 42*a*, 42*b*, 42*c* and 42*d* and 43 are arranged at sites where the handle portion 5B gripped by the operator is removed. The air suction ports 41, which are one of the air windows, are arranged at two sites on the upper left and upper right sides. The second air suction ports are the four air suction ports 42*a*, 42*b*, 42*c* and 42*d* that are formed to line up in the up-down direction at the front end of the rear cover 4 and near a connection portion between the rear cover 4 and the motor housing 2. The air suction ports 42*a*, 42*b*, 42*c* and 42*d* are elongated slit-shaped openings disposed obliquely in a side view. In this example, air suction ports 43 are further arranged adjacent to the lower side of the air suction ports 41 so as to exert a special effect on the air suction ports 41. Although forming a rear part of the housing portion, the large-diameter portion 5A is not the part for the operator to grip. By arranging the air suction ports 41, 42*a*, 42*b*, 42*c* and 42*d* and 43 in the housing part excluding the handle portion 5B in this manner, the air suction ports 41, 42*a*, 42*b*, 42*c* and 42*d* and 43 can be prevented from being blocked by the gripping hand of the operator. The shape of the air suction port 41 is not a perfect rectangle in a side view, the rear edge is slanted and a horizontal surface is formed on the front side of the rear edge. The air suction ports 43 are additionally formed so that dust does not easily enter the air suction ports 41, and the air suction ports 43 have a substantially L-shape along the edge portions on the lower side and the rear side of the air suction ports 41. The opening area of the air suction port 43 is made sufficiently smaller than that of the air suction port 41.

The handle portion 5B of the rear cover 4 is subjected to concave-convex processing 4*c* to increase the contact resistance with the finger of the operator in order that the operator easily grips the handle portion 5B and slips difficultly. A terminal portion 4*d* slightly bent downward is formed at the end side sufficiently rearward of the handle portion 5B so as to prevent the gripping hand from shifting to the rear side. In addition, the handle portion 5B also has a guiding function so that the trigger lever 64 is difficult to be erroneously operated when the grinder 1 is placed on the floor. A through-hole 50 through which the power cord 28 passes is formed on the division surface at the rear end of the rear cover 4, and the power cord 28 is drawn out. The trigger lever 64 has a sufficient length occupying more than half of the handle portion 5B, and the front side of the trigger lever 64 swings up and down. On the front side of the trigger lever 64, a lock lever 65 for off-lock and/or on-lock is arranged.

Figure 4:
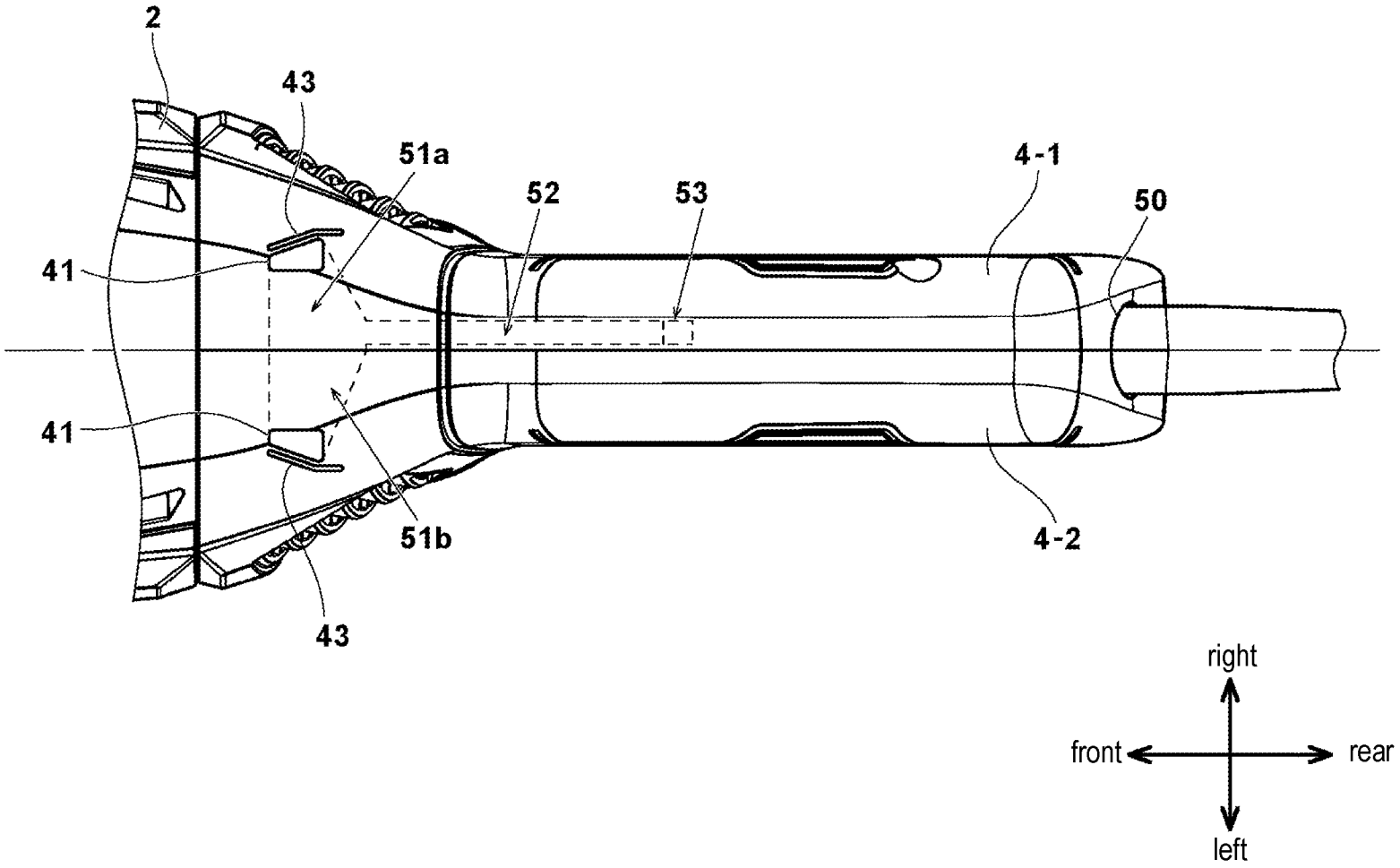
FIG. 4 is a top view of the rear cover 4 of the grinder 1 according to the example of the present invention.

FIG. 4 is a top view of the rear cover 4 of the grinder 1 according to the example of the present invention. Here, a dotted line 52*a* indicates the position of the passage of the cooling air from the air suction ports 41 disposed at two sites on the left and right sides to the opening 53. Internal spaces 51*a* and 51*b* are respectively formed in the inner parts of the air suction ports 41 close to the division surface. The internal spaces 51*a* and 51*b* communicate with each other in the left-right direction, and the passage 52 is connected to the rear side of the internal space 51*a*. The opening 53 is formed at the rear end of the passage 52. With this configuration, from the air suction ports 41 arranged at two sites on the left and right sides to the opening 53, one air path of the cooling air is formed, and one way of the U-turn-shaped passage passing through the handle portion 5B added in this example is formed. The internal spaces 51*a* and 51*b* or the passage 52 are formed along the outer wall surface of the rear cover 4. The passage 52 and the opening 53 are formed using an inlay type concave portion of the rear cover 4-1 on the right left, and the internal space 51*b* is formed on the lower side of an inlay type convex portion of the rear cover 4-2 on the right (details are described later with reference to FIGS. 7-9).

Figure 5:
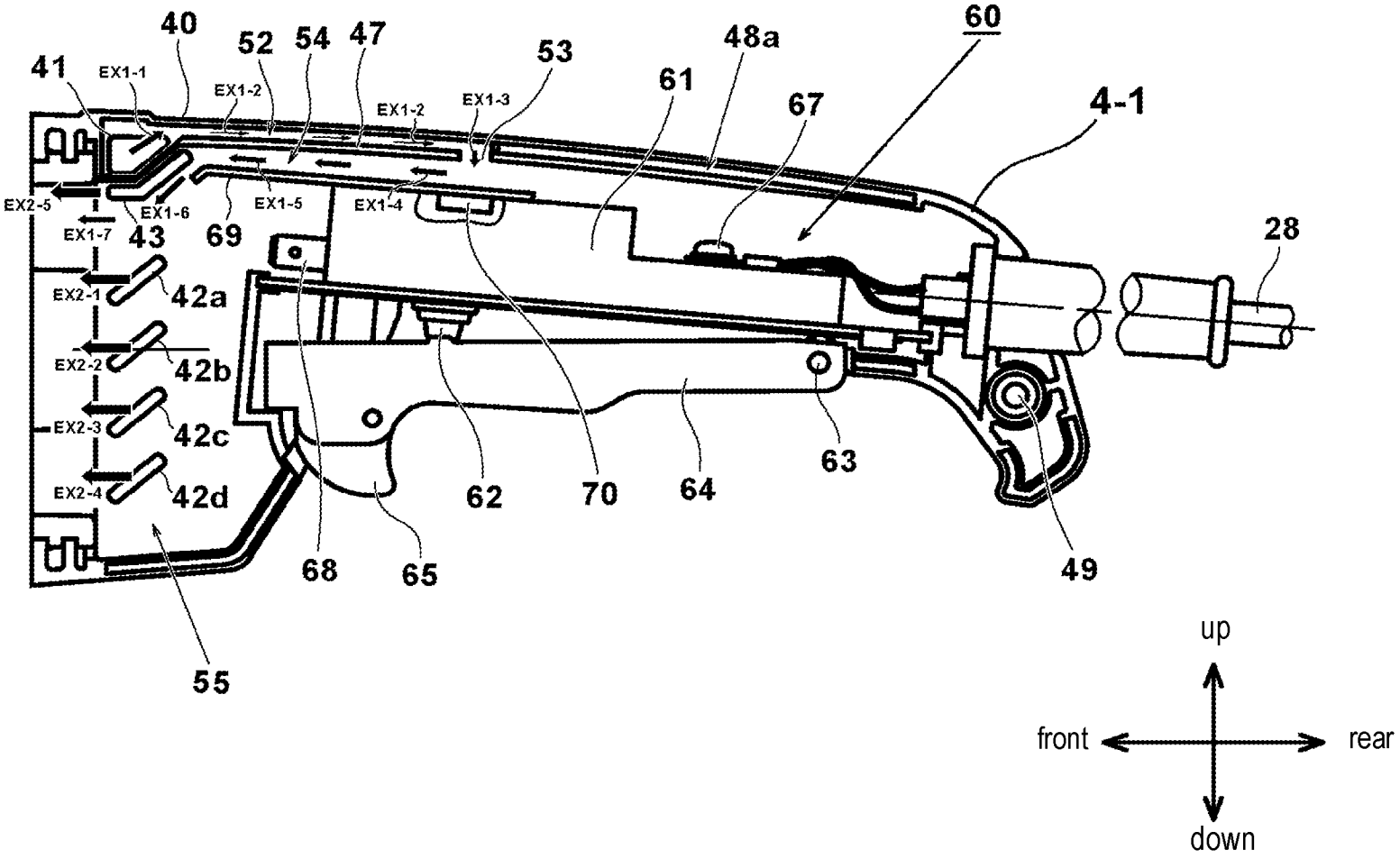
FIG. 5 is a side view for illustrating an air path of first cooling air in a rear cover 4-1 of the grinder 1 according to the example of the present invention.

FIG. 5 is a side view for illustrating the air path of the first cooling air in the rear cover 4-1 of the grinder 1 of the example of the present invention. Here, a side view is shown in which the rear cover 4-2 on the left is removed. The air path of the cooling air taken into the motor housing 2 mainly has two systems. One is the cooling air EX1 (the first cooling air) taken in from the air suction ports 41. When the trigger lever 64 is pulled and the switch is turned on, the rotor of the motor 6 starts rotating, and atmospheric air is sucked from the air suction ports 41 by the action of the cooling fan 8 arranged on the rotary shaft 7. The sucked air flows rearward from EX1-1 to EX1-2 so as to pass through the inside of the passage 52 configured along the outer wall surface 40 of the rear cover 4. The direction to the rear side is a direction of getting away from the cooling fan 8 and the air discharge port 13*a* with the air suction ports 41 as a reference. A guide rib 47 is formed on the inner side of the outer wall surface 40 of the rear cover 4-1 near the division surface, and a so-called double structure is formed. The inner part of the double structure serves as the passage 52, and the opening 53 is formed at the rear end of the passage 52. An airflow EX1-3 discharged from the opening 53 reaches the internal space 54 in which the switch unit 60 is accommodated. Because the front side of the internal space 54 is spatially linked with the internal space 55 of the large-diameter portion 5A on the front side (a part of the housing portion in the present invention), the air flows at the shortest distance from the opening 53 toward the front side. As a result, the air flows as shown by EX1-4 to EX1-7 in FIG. 5, and the cooling air EX1-1 to EX1-7 forms a passage (U-turn passage) for reaching the handle portion 5B from the housing portion and making a U-turn to return to the inside of the housing portion. The heat-radiation plate 69 transfers heat by directly or indirectly contacting a heat-generation section (a heat-generation member such as a switching element 70 or the like) in the switch unit 60, and effectively releases the heat of the heat-generation section by being exposed to the cold air such as EX1-4 to EX1-5. The heat-radiation plate 69 is formed so as to extend farther forward than the housing body of the switch housing 61 along the cooling air EX1-4 to EX1-5. In addition, the front end of the heat-radiation plate 69 has a shape that is bent obliquely downward, and is inclined along an inclined surface portion 47*a* (see FIG. 6) on the front side of the guide rib 47 of the rear cover 4, guiding the cooling air EX1-6 obliquely downward.

The air sucked by the cooling fan 8 via the air suction openings 42*a*, 42*b*, 42*c* and 42*d* flows forward toward the cooling fan 8 as indicated by arrows EX2-1 to EX2-4. Similarly, the cooling air EX2-5 flows forward from the air suction ports 43 toward the cooling fan 8. The cooling air EX1-1 to 3, which temporally flows in the direction (rearward) opposite to the direction of the cooling fan 8 through the passage 52, flows from the opening 53 back to the direction of the cooling fan 8, merges with the cooling air EX2-1 and EX2-5 near the air suction ports 42*a* and 43 and flows to the motor housing 2 side. In this manner, when the outside air is sucked by the cooling fan 8, a so-called U-turn air path in which a part of the outside air flows rearward as shown by EX1-1 to EX1-3 and flows forward along the heat-radiation plate 69 attached to the switch unit 60 is formed in the handle portion 5B. Therefore, the heat-generation member or the heat-radiation member located in the U-turn air path can be effectively cooled. Besides, the cooling air (EX1-4 to EX1-6) in the return part of the U-turn air path is not limited to the upper part of the heat-radiation plate 69 and may flow to both side surfaces of the switch housing 61.

The heat-radiation plate 69 is formed so as to extend from the vicinity of the center of the switch housing 61, which is elongated in the front-rear direction, to the large-diameter portion 5A forming the housing portion across the front end of the handle portion 5B. However, the size of the heat-radiation plate 69 is arbitrary and may be appropriately set according to the size of the internal space in the rear cover 4. Because the front end of the heat-radiation plate 69 is bent downward, the flow of the cooling air from EX1-5 to EX1-6 is smoothly guided. In addition, the air suction ports 43 serving as openings of the flow of the second cooling air EX2-5 are arranged near the flow of the cooling air EX1-5. The air suction ports 43 are arranged to increase the effect that the cooling air EX1-5 is drawn by the flow of the air sucked into the housing from the air suction ports 43, and to make it difficult for the dust including metal powder to enter the U-turn air path side from the air suction ports 41. In the present invention, the opening area of the air suction port 43 is made sufficiently smaller than that of the air suction port 41, and thereby the flow velocity of the air entering the air suction port 43 is made faster than the flow velocity of the air entering the air suction port 41, and thus the dust floating near the air suction ports 41 is sucked into the air suction port 43. Thereby, it is possible to effectively prevent the metal powder and the like from entering the passage 52 via the air suction ports 41.

The switching element 70 is disposed inside the switch housing 61 together with other electronic elements such as a microcomputer and the like which are not shown. Here, because the opening 53 is opened above the switching element 70 serving as a heat-generation member, it is possible to effectively cool the particularly hot site of the switch unit 60 by the cooling air EX1 taken into the handle portion 5B. In addition, because the air suction port 41 serving as an entrance opening of the passage 52 is located forward of the handle portion 5B, the air suction ports 41 are not blocked no matter how the operator grips the handle portion 5B. In addition, when the handle portion 5B is gripped near the air suction ports 41 with a work glove or the like worn on, the fibers of the glove may be sucked inside. However, in the structure of this example, the air suction ports 41 are located forward of the handle portion 5B at sufficiently separated positions, and thus there is little worry.

Figure 6:
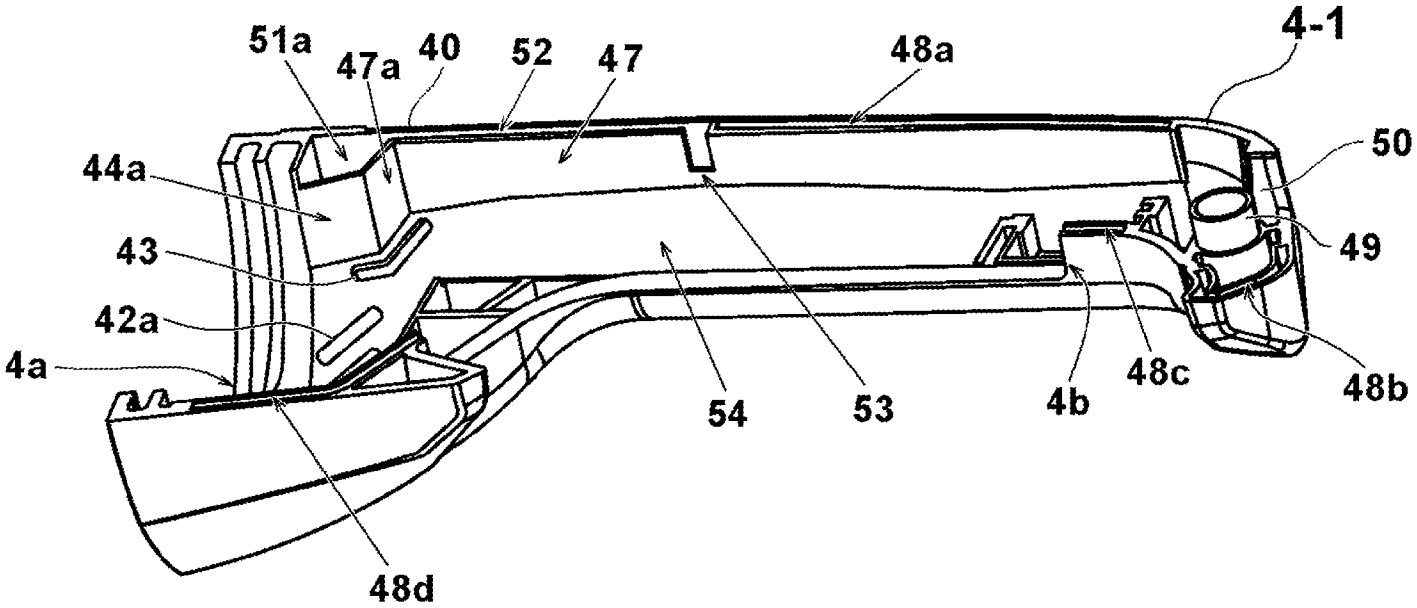
FIG. 6 is a perspective view in which the single rear cover 4-1 in FIG. 5 is viewed from the inner wall side.

FIG. 6 is a perspective view of the inner wall side of the rear cover 4-1 on the right side of the grinder 1 of the example. An opening portion 4*a* for connection to the motor housing 2 is arranged on the front side of the rear cover 4-1, and an opening portion 4*b* for accommodating the trigger lever 64 is arranged below the thin part of the rear cover 4-1. In order to form the U-turn air path, the vicinity of the upper division surface of the rear cover 4-1 is formed into a double structure of the outer wall surface 40 and the guide rib 47. The opening 53 is arranged on the inner side near the rear end of the passage 52. The opening 53 is formed only in the right part of the rear cover 4, and no opening 53 is arranged in the rear cover 4-2 on the left (described later with reference to FIG. 8). The guide rib 47 is formed to extend horizontally toward the left direction from the right side surface of the rear cover 4-1 on the right, and comes into contact with the division surface of the left rear cover 4-2. On the rear side of the opening 53, a concave portion 48*a* for forming an inlay structure is formed. Besides, not only the concave portion 48*a* is formed, but concave portions 48*b*, 48*c* and 48*d* are also formed at other sites to facilitate the joining of the rear covers 4-1 and 4-2 on the left and right by the inlay structure. A through-hole 50 and a screw boss 49 are arranged near the rear end of the rear cover 4-1. Although only one screw boss 49 is shown in the drawing of the example for convenience of description, actually about four screw bosses 49 are arranged on the rear cover 4-1, and the rear covers 4-1 and 4-2 are fixed by screws not shown.

Figure 7:
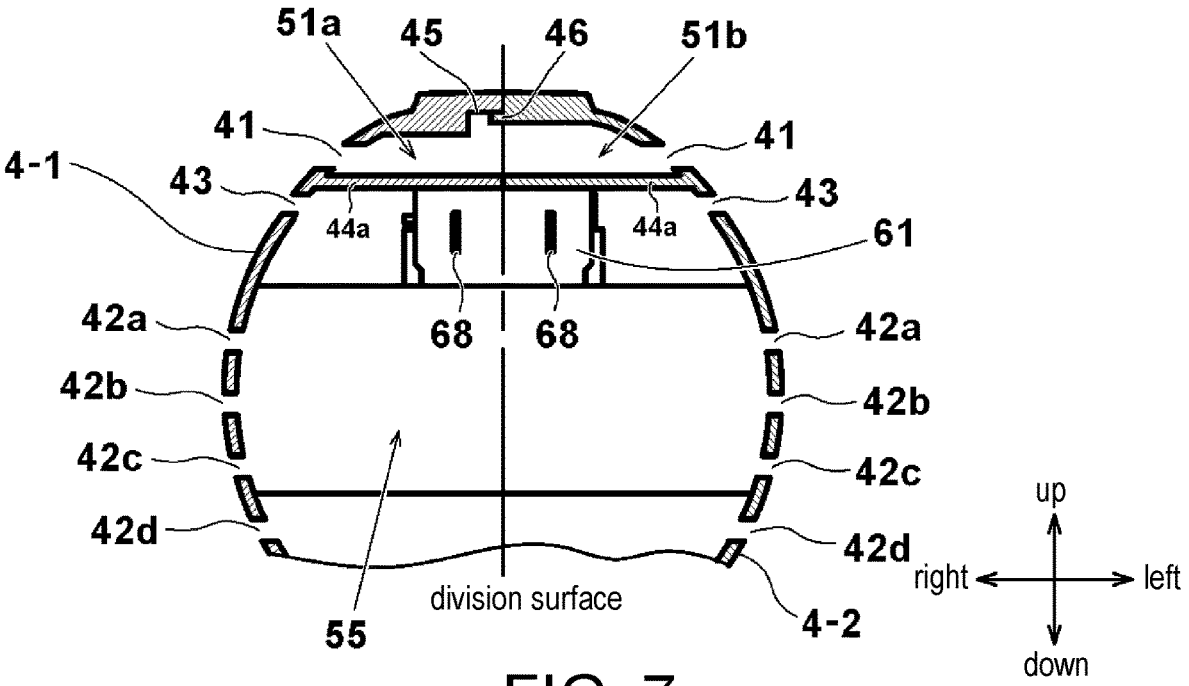
FIG. 7 is a cross-sectional view of an A-A portion in FIG. 2.

FIG. 7 is a cross-sectional view of an A-A portion in FIG. 2 and shows a cross-sectional shape in the large-diameter portion 5A of the rear cover 4. The rear cover 4 is formed by a right part (4-1) and a left part (4-2) and is fixed by screws not shown in a state that these parts are joined. A concave portion 45 which is recessed in the circumferential direction from the division surface is formed on the upper division surface of the rear cover 4-1. Here, the concave portion 45 has a shape in which one wall thereof is cut off. A convex portion 46 is formed on the upper division surface of the rear cover 4-2 so as to protrude toward the rear cover 4-1 side. Here, the convex portion 46 has an L-shape in which one side of the wide base part is cut off; however, the convex portion 46 is arbitrarily set into a convex shape or an L-shape as long as the protrusion part of the convex portion 46 enters the recess in the concave portion 45. The concave portion 45 and the convex portion 46 are formed to be continuous in the longitudinal direction, and the rear cover 4-1 and the rear cover 4-2 are joined so that the convex portion 46 is fitted into the concave portion 45. The so-called "inlay structure" is employed for joining the rear cover 4 divided in the left-right direction in this manner, and thus the upper wall surface of the rear cover 4-1 and the upper wall surface of the rear cover 4-2 can be accurately aligned in the up-down direction.

A plurality of air suction ports 42*a*, 42*b*, 42*c* and 42*d* is formed on the left and right sides near the center of the rear covers 4-1 and 4-2 when viewed in the up-down direction. The air sucked from the air suction ports 42*a*, 42*b*, 42*c* and 42*d* flows directly into the internal space 55 of the large-diameter portion 5A. Two air suction ports 41 are arranged at two sites on the left and right on the upper side of the rear cover 4. The internal spaces 51*a* and 51*b* communicate with each other in the left-right direction at the positions of the air suction ports 41, and the internal spaces 51*a* and 51*b* are isolated from the internal space 55 by being closed with a guide rib 44*a* which extends from the left-right direction toward the division surface on the lower side of the internal spaces 51*a* and 51*b*. In FIG. 7, a part of the front end of the switch housing 61 is visible, but the heat-radiation plate 69 (see FIG. 5) is not visible from this cross-sectional position. At the front end of the switch housing 61, two secondary terminals 68 are arranged side by side in the left-right direction, but in this example, a wiring group from the secondary terminals 68 toward the motor 6 is not shown. The air suction ports 43 are respectively arranged below the parts of the rear covers 4-1 and 4-2 to which the guide rib 44*a* is attached. The air suction ports 43 communicate with the internal space 55 of the large-diameter portion 5A, but do not communicate with the internal spaces 51*a* and 51*b* on the air suction port 41 side. The internal spaces 51*a* and 51*b* are spaces linked to the first passage 52 (see FIGS. 5 and 6).

Figure 8:
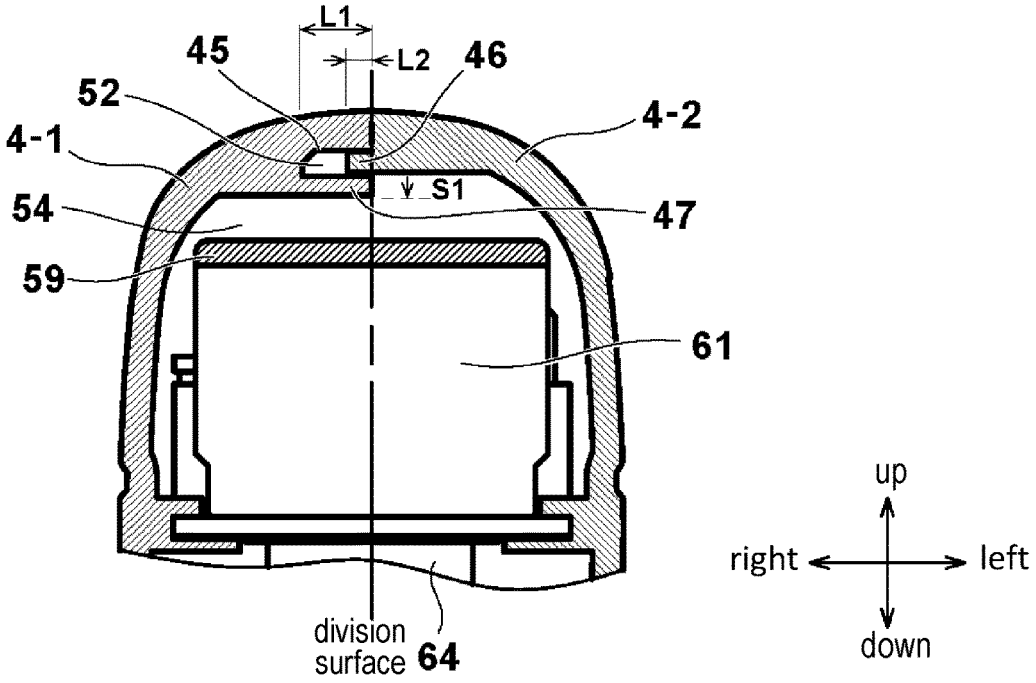
FIG. 8 is a cross-sectional view of a B-B portion in FIG. 2.

FIG. 8 is a cross-sectional view of a B-B portion in FIG. 2 and passing through the closed passage 52. The width in the left-right direction of the internal spaces 51*a* and 51*b* shown in FIG. 7 is reduced as shown by a dotted line in FIG. 4, and the narrow passage 52 which only uses the concave portion 45 of the inlay structure is formed at the cross-sectional position of B-B. In other words, the passage 52 communicates with the internal spaces 51*a* and 51*b* in FIG. 7. In the cross-sectional view of the B-B portion, because the passage 52 and the internal space 54 for accommodation on the switch housing 61 side form the guide rib 47, and a depth L1 of the groove extending in the right direction (the plane direction) of the concave portion 45 is sufficiently larger than a height L2 of the protrusion of the convex portion 46, a gap formed in the concave portion 45 can be used as the passage 52. In addition, the space of the passage 52 is isolated by the guide rib 47. In order to use the concave portion 45 constituting the inlay structure to form an air path in this manner, the thickness of the upper wall surfaces of the rear covers 4-1 and 4-2 at the cross-sectional position of B-B is increased, and the shape of the concave portion 45 and the convex portion 46 is also larger than other sites. Besides, in the cross-sectional position of B-B portion, only the convex portion 46 is formed so as to protrude to the rear cover 4-1 side on the upper wall surface of the left rear cover 4-2, and has the same shape as the conventional convex portion 46 of the inlay structure except for the size. Conversely, the depth of the concave portion 45 (the distance L1 in the left-right direction) is sufficiently greater than the protrusion height of the convex portion 46 (the distance L2 in the left-right direction). In this manner, the passage 52 can be formed using the joining part formed by the inlay structure in the example. In addition, the formation of the passage 52 can prevent the rear cover 4 (4-1, 4-2) from being enlarged, and thus the passage 52 can be formed with the same size as the side in the conventional grinder. In addition, even if the passage 52 is clogged with dust or the like, the clogging in the concave portion 45 can be easily removed by dividing the rear cover 4 into right and left parts. Besides, in the cross section B-B of FIG. 8, the contact object on the left side of the guide rib 47 is not formed on the rear cover 4-2 side; however, the contact object may also be formed on the rear cover 4-2 side. In this case, the thickness may be set so that the inner position of the upper wall surface of the rear cover 4-2 is moved downward as indicated by an arrow S1.

Figure 9:
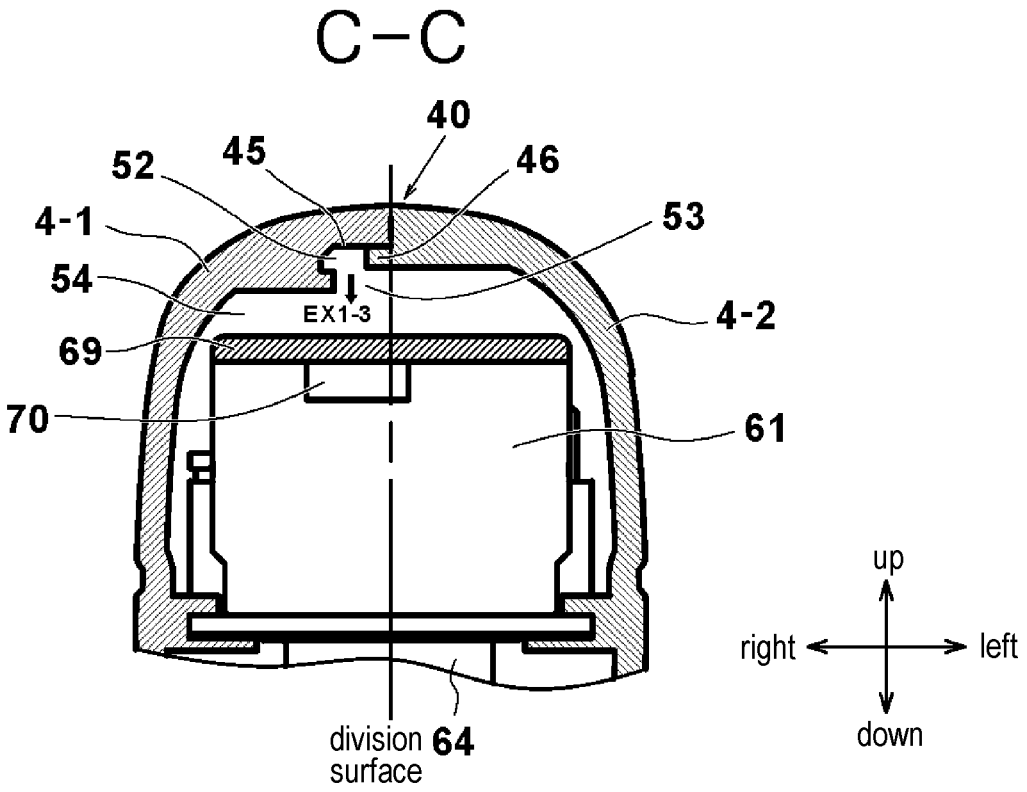
FIG. 9 is a cross-sectional view of a C-C portion in FIG. 2.

FIG. 9 is a cross-sectional view of a C-C portion in FIG. 2. The shape of the convex portion 46 of the rear cover 4-2 on the left is the same as at the cross-sectional position of the B-B portion. However, the lower side of the concave portion 45 of the rear cover 4-1 on the right becomes the opening 53 (see also FIG. 6) that is cut out, and thus the passage 52 communicates with the internal space 54 in which the switch housing 61 is accommodated. As a result, the air flowing parallel to the direction of the center axis A1 at the cross-sectional position of the C-C portion flows so as to bend downward from the passage 52. This becomes the flow of the cooling air EX1-3 (see also FIG. 5). The cooling air EX1-3 blows against the heat-radiation plate 69 located immediately below the opening 53, thereby effectively removing heat from the heat-radiation plate 69. The switching element 70 such as a triac or the like is accommodated inside the switch housing 61 below the heat-radiation plate 69. Besides, the heat-generation member cooled using the heat-radiation plate 69 is not limited to the switching element 70 such as a triac or the like, and may be other elements that generate heat or a site to be cooled. In addition, a circuit board may be disposed and electronic elements such as a microcomputer and the like may be mounted in the switch housing 61.

As described above, according to this example, the air suction ports are arranged in the housing that accommodates the cooling fan and the motor, and the passage extending in the direction from the air suction ports to the handle portion connected to the housing and returning to the housing again through the handle portion is arranged. Thereby, it is possible to cool the heat-generation member arranged in the handle portion without arranging the air suction ports in the handle portion. In addition, the example has a configuration in which the electric power supply portion (the power cord) is arranged at the end of the handle portion opposite to the housing, and the return part of the passage is disposed at a position closer to the cooling fan than the connection part connecting the electric power supply portion and the switch unit. Thereby, it is possible to make it difficult for the cooling air to pass through the electric connection part (the connection terminal) between the electric power supply portion and the switch unit, and thus the influence caused by dust or the like mixed and intruding into the cooling air can be suppressed.

In addition, the dedicated passage 52 for causing the cooling air EX1 to flow toward a predetermined direction, particularly in an opposite direction separated from the cooling fan 8 of the housing portion is formed inside the handle portion, and the cooling air EX1 is directly guided to the vicinity of the switching element 70 serving as a heat-generation source. Because the heat-radiation plate 69 is directly or indirectly connected to the switching element 70, it is possible to efficiently cool the switching element 70 which is a heat-generation source by blowing the cooling air EX1 against the heat-radiation plate 69. In addition, by arranging the passage 52 between the heat source and the outer wall surface 40 of the handle portion 5B, the heat transmitted to the hand by the heat source can be blocked. Because the cooling performance of the switch housing 61 is remarkably improved by this example, it is also possible to accommodate a control circuit such as a micro-computer (microcomputer) inside the switch housing 61. If the microcomputer is mounted inside the switch unit 60, the performance of rotation control of the motor 6 is remarkably improved, and the manufacturing assemblability of the control circuit is improved, and the reduction in size of the power tool can also be achieved. Furthermore, the air suction ports 41, which are introduction ports of the first cooling air for cooling the switch unit 60, are disposed on the housing portion side excluding the handle portion 5B gripped by the operator, and thereby it is possible to prevent the air suction port 41 from being blocked by the hand of the operator and to effectively prevent the occurrence of the fiber suction phenomenon of a glove or the like.

Example 2

Figure 10:
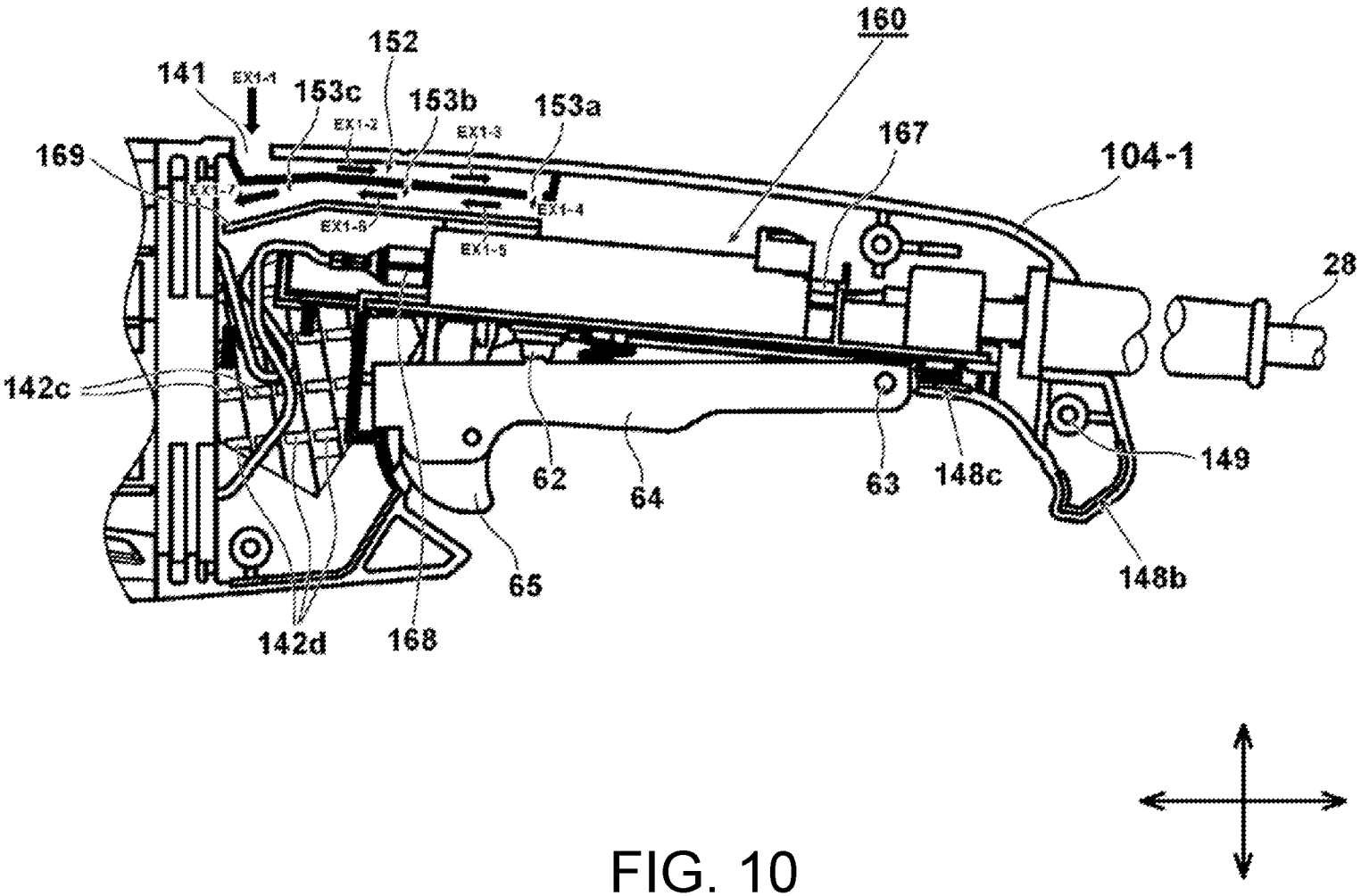
FIG. 10 is a left side view of a rear cover 104-1 of a grinder according to a second example of the present invention.

Next, the structure of a rear cover 1044 of a grinder according to a second example of the present invention is described using FIG. 10. The basic structure is the same as that of the first example, but the shape of an air suction port 141 and the number of openings 153*a*, 153*b* and 153*c* serving as outlets of the first passage are different. The shape of the switch unit 160 is also slightly changed. The structure in which a primary terminal 167 of the switch unit 160 is arranged on the rear side and a secondary terminal 168 is arranged on the front side is the same as that of the first example, and the same parts as that of the first example are used near the trigger lever 63. Only one opening 53 is arranged in the rear cover 4-1 shown in FIG. 5. On the contrary, three openings 153*a*, 153*b* and 153*c* are arranged in a rear cover 104-1 of the second example. The cooling air EX1-1 is sucked from an air suction port 141 in the rear cover 104-1 and flows rearward as shown by EX1-2 to EX1-3 through the dedicated passage 152. At this time, the openings 153*a*, 153*b* and 153*c* are arranged at three different sites in the front-rear direction as outlets from the passage 152 to the accommodation space side of the switch unit 160, and at each site, the cooling air is discharged downward toward the heat-generation plate 169. The amount of air decreases from the air suction port 141 toward the rear side in the passage 152, and thus the sizes of the opening areas of the openings 153*a*, 153*b* and 153*c* are adjusted in consideration of the pressure ratios thereof. That is, the opening 153*a* has the largest opening area, the opening 153*b* has a smaller opening area than the opening 153*a*, and the opening 153*c* has an even smaller opening area than the opening 153*b*. By forming in this manner, the cooling air guided to the passage 152 is exposed to the downward cooling air at three sites of the heat-radiation plate 169, and thereby the heat-radiation effect of the heat-radiation plate 169 can be further enhanced. The cooling air (EX1-4 and the like) discharged downward from the openings 153*a*, 153*b* and 153*c* merges with EX1-5, EX1-6, EX1-7 and flows forward to flow into the internal space of the motor housing 2 (see FIG. 2).

The shape of the second air suction ports 142*c*, 142*d* and the like of the rear cover 104-1 is different from the shape of the first air suction ports 42*c*, 42*d* and the like. However, this is due to a difference in design of the outer surface shape of the rear cover 104-1, and the operation principle and the effect are the same. Besides, the rear cover 104-1 is not provided with an air suction port corresponding to the air suction port 43 in the first example. However, it is evident that a similar air suction port may be arranged near the air suction port 141.

As described above, the gist of the present invention is that: the handle portion is connected to the housing portion which has the air suction ports and the air discharge ports and accommodates the motor and the fan for motor cooling, and the air from the air suction ports is transmitted into the handle portion in the manner of being separated from the air discharge ports, thereby cooling the heat-generation member (the object to cooled) accommodated in a part different from the housing portion. Accordingly, the heat-generation member can be cooled without arranging air windows at the accommodation site of the heat-generation member. In addition, when the motor and the fan are accommodated inside the housing portion and the motor is cooled by the fan inside the housing portion, the fan for motor cooling can be used to cool the heat-generation member accommodated in the handle portion or the like. Furthermore, it is possible to control the air path/air volume at the accommodation site of the heat-generation member; in other words, it is possible to easily separate a region in which the air flows from a region in which the air does not flow at the accommodation site of the heat-generation member. This is particularly effective in the following type of power tool in which the electric power supply portion (the power cord 28) is arranged at the rear end (one end side) of the handle portion 5B and the motor housing 2 (the housing portion) is arranged at the front end (the other end side) of the handle portion 5B as in the grinder 1 which is the example of the present invention. Because the air can flow only in a front region inside the handle portion 5B, it is easy to form a configuration that does not allow the air to pass through the connection part between the electric power supply portion (the power cord) behind the handle portion 5B and the switch in the handle portion.

The present invention has been described above based on the examples, but the present invention is not limited to the above examples, and various modifications can be made without departing from the gist of the present invention.

For example, in the above examples, the air suction ports 41 and 141 are arranged in the large-diameter portion 5A that is a part of the housing portion. However, the air suction ports 41 and 141 may also be arranged in the motor housing 2 or the gear case 3 that is also a part of the housing portion. If the air suction case 41 is arranged in the gear case 3, a passage directed from the air suction case 41 toward the handle portion 5B via the motor housing 2 and the large-diameter portion 5A may be arranged, and the same effect as that of the above examples can also be obtained in this case.

In addition, the configuration has been described in which the switching element 70 disposed in the handle portion 5B is cooled as a heat-generation member to be cooled, but the heat-generation member is not required to be disposed in the handle portion 5B. For example, in the case of a grinder as described in patent literature 2, the switch mechanism is accommodated in a front part of the rear cover. In the case of this example, for example, the air suction ports and the air discharge ports are arranged in the gear case, and the passage extending from the air suction ports toward the side opposite to the air discharge port and reaching the front part of the rear cover via the motor housing is arranged. Thereby, it is possible to allow the cooling air to flow only in the front part of the rear cover as in the above examples. In this case, the periphery of the switch mechanism can be locally cooled even in the grinder as disclosed in patent literature 2, and the air does not need to flow through the connection part (the connection terminal) between the power cord (the electric power supply portion) and the switch mechanism. In addition, patent literature 2 discloses a cordless power tool using a battery pack, but the present invention is also effective in this cordless power tool. That is, although the power supply is an AC power supply in the first example, the power supply may also be a rechargeable battery pack. Even in this case, according to the present invention, it is easy to form a configuration in which the air is caused not to pass through the connection part between the battery pack used as a power supply and the switch in the handle portion as much as possible.

In addition, the grinder is used as an example of the power tool to make description in the above examples, but the present invention can be applied to any power cool, in which the housing portion that accommodates a motor, a cooling fan or the like and has an air suction port and an air discharge port and the handle portion connected to the housing portion are formed, and which accommodates a certain heat-generation member in a part different from the housing portion, for example, the handle portion. In addition, the power tool in which the gripped part extends along the longitudinal direction of the cylindrical housing member is described in the above examples, but the present invention can also be applied to a power tool in which the gripped part having a D-shape in a side view is formed in the housing portion. In this case, the air suction port is arranged in the housing portion excluding the gripped part, the air introduced from the air suction port is drawn into the gripped part, and a U-turn is made for the cooling air drawn into the gripped part to return the cooling air to the housing portion side excluding the gripped part again. As long as the U-turn passage can be formed in the handle portion in this manner, the present invention can be applied to a power tool having a housing of an arbitrary shape.

What is claimed is:

1. A power tool, comprising:

a main body, the main body comprising a housing portion and a handle portion extending from the housing portion, the housing portion accommodates a motor having a stator and a rotor, and a cooling fan that cools the motor, and has a first air suction port and a second air suction port and an air discharge port;

the handle portion accommodates a switch capable of turning on/off the motor by an operation of an operator, a flow of a first cooling air flowed from the first air suction port toward the motor and a flow of a second cooling air flowed from the second air suction port toward the motor are generated by the cooling fan;

a passage extending from the first air suction port at the housing portion to the handle portion and returning to the housing through the handle portion is arranged;

the first cooling air and the second cooling air cool the motor after merging with each other and are sucked by the cooling fan and, wherein the first cooling air and the second cooling air are discharged to an outside from the air discharge port arranged in the housing portion after cooling the motor; and wherein the switch is cooled by the first cooling air flowing in the passage, and the passage extending from the first air suction port to the handle portion is isolated from the flow of the second cooling air.

2. The power tool according to claim 1, wherein the rotor is rotating in an axis extending along a front-rear direction, the motor and the handle portion are arranged away from each other in the front-rear direction, and the first air suction port is arranged between the handle portion and the motor in the front-rear direction.

3. The power tool according to claim 2, wherein the second air suction port is arranged between the handle portion and the motor in the front-rear direction.

4. The power tool according to claim 1, wherein a heat-generation member is arranged in the switch.

5. The power tool according to claim 4, wherein a heat-radiation plate is arranged in the heat-generation member, and the heat-radiation plate is exposed to the flow of the cooling air directed from the first air suction port toward the cooling fan.

6. The power tool according to claim 5, wherein the heat-radiation plate is disposed so as to have a surface parallel to a flow direction of the first cooling air in the handle portion.

7. The power tool according to claim 1, wherein a plurality of the first air suction ports and a plurality of the second air suction ports are arranged in the housing portion;

one of the second air suction ports is disposed adjacent to a front side or a lower side of the first air suction port; and an opening area of the second air suction port disposed adjacent to the first air suction port is made smaller than that of an inlet of the first air suction port.

8. The power tool according to claim 1, wherein the handle portion is configured so that it can be divided into a left portion and a right portion, and wherein the passage is formed by engagement of a convex portion formed on one of the left portion and the right portion and a concave portion formed on the other.

9. The power tool according to claim 8, wherein an electric power supply portion is arranged at an end far from the housing portion in the handle portion; and the first cooling air is configured to U-turn at a position closer to the cooling fan than a position of a connection part connecting the electric power supply portion and the switch unit in the handle portion.

10. A power tool, comprising:

a main body, the main body comprising a housing portion and a handle portion extending from the housing portion, the housing portion accommodates a motor that has a stator and a rotor, and a cooling fan that cools the motor, and has an air suction port and an air discharge port;

air is sucked into the housing portion from the air suction port by a rotation of the cooling fan; and wherein the air flows from the housing portion to the handle portion, wherein, in the handle portion, the air cools a switch capable of turning on/off the motor by an operation of an operator or cools a control element that controls the motor, and the air returns to the housing portion after cooling the switch or the control element and cools the motor in the housing portion before discharging from the air discharge port.

11. The power tool according to claim 10, wherein the control element is disposed in a passage through which the air passes.

12. The power tool according to claim 11, wherein the switch is accommodated inside the handle portion, and the control element is arranged in the switch.

13. The power tool according to claim 12, wherein the rotor is rotating in an axis extending along front-rear direction, the motor and the handle portion are arranged away from each other in the front-rear direction, and the air suction port is arranged between the motor and the handle portion in the front-rear direction.

14. The power tool according to claim 11, wherein the handle portion is formed by being divided in a left-right direction; and the passage is formed by overlapping a concave portion formed to extend in one surface direction from a joining surface of the housing joined in a two-part shape and a convex portion formed to block the concave portion from the other surface direction.

15. The power tool according to claim 10, wherein an electric power supply portion for supplying an electric power to the motor are arranged in the handle portion, in a space connecting the electric power supply portion and the air discharge port, the air suction port is located between the air discharge port and the electric power supply portion, an electric connection part of the switch and the electric power supply portion is located between air suction port and the electric power supply portion, the air is configured to U-turn at a position closer to the cooling fan than a position of the connection part.

16. The power tool according to claim 10, wherein the handle portion is thinner than the motor.

17. The power tool according to claim 10, wherein the rotor is rotating in an axis extending along a front-rear direction, the handle portion is extending rearward from a rear end of the housing portion, the motor and the handle portion arranged away from each other in the front-rear direction.

18. The power tool according to claim 10, wherein the air is configured to cool the control element, and wherein the control element is a switching element that controls the motor.

* * * * *